US009593577B2

(12) United States Patent
Lachmann et al.

(10) Patent No.: US 9,593,577 B2
(45) Date of Patent: Mar. 14, 2017

(54) PICK TOOL HAVING A SUPER-HARD PLANAR STRIKE SURFACE

(71) Applicants: ELEMENT SIX GMBH, Burghaun (DE); ELEMENT SIX ABRASIVES S.A., Luxembourg (LU)

(72) Inventors: Frank Friedrich Lachmann, Burghaun (DE); Robert Fries, Springs (ZA); Bernd Heinrich Ries, Burghaun (DE)

(73) Assignees: Element Six GmbH, Burghaun (DE); Element Six Abrasives S.A., Luxembourg (LU)

( * ) Notice: Subject to any disclaimer, the term of this patent is extended or adjusted under 35 U.S.C. 154(b) by 71 days.

(21) Appl. No.: 14/430,020

(22) PCT Filed: Sep. 25, 2013

(86) PCT No.: PCT/EP2013/070001
§ 371 (c)(1),
(2) Date: Mar. 20, 2015

(87) PCT Pub. No.: WO2014/049010
PCT Pub. Date: Apr. 3, 2014

(65) Prior Publication Data

US 2015/0240635 A1 Aug. 27, 2015

Related U.S. Application Data

(60) Provisional application No. 61/707,309, filed on Sep. 28, 2012, provisional application No. 61/718,093, filed on Oct. 24, 2012.

(30) Foreign Application Priority Data

Sep. 28, 2012 (GB) ..... 1217433.0
Oct. 24, 2012 (GB) ..... 1219082.3

(51) Int. Cl.
*E21C 35/18* (2006.01)
*E21C 35/183* (2006.01)
(Continued)

(52) U.S. Cl.
CPC ..... *E21C 35/183* (2013.01); *B22F 5/00* (2013.01); *C22C 26/00* (2013.01);
(Continued)

(58) Field of Classification Search
CPC ..... B28D 1/186; E21C 35/183
See application file for complete search history.

(56) References Cited

U.S. PATENT DOCUMENTS 3,856,359 A 12/1974 Krekeler
4,194,790 A 3/1980 Kenny et al.
(Continued)

FOREIGN PATENT DOCUMENTS

EP 0283605 A1 9/1988
EP 2053198 A1 4/2009
(Continued)

OTHER PUBLICATIONS

Search Report for GB1219082.3 dated Mar. 22, 2013.
(Continued)

*Primary Examiner* — John Kreck
(74) *Attorney, Agent, or Firm* — Dean W. Russell; Clark F. Weight; Kilpatrick Townsend & Stockton LLP

(57) ABSTRACT

A pick tool (100) comprising a strike member (110) non-moveably attached to a pick body (120), the strike member comprising a strike structure. The strike structure comprises super-hard material and defines a planar strike surface (112), the strike surface defining a cutting edge (114) that includes an apex (115) in the plane of the strike surface (112). The
(Continued)

thickness of at least a proximate volume (107) of the strike structure adjacent the cutting edge (114) is at least about 2 millimeters.

12 Claims, 8 Drawing Sheets

(51) Int. Cl.
*C22C 26/00* (2006.01)
*B22F 5/00* (2006.01)

(52) U.S. Cl.
CPC .... *B22F 2005/001* (2013.01); *C22C 2204/00* (2013.01); *E21C 2035/1806* (2013.01); *E21C 2035/1813* (2013.01); *E21C 2035/1816* (2013.01)

(56) References Cited

U.S. PATENT DOCUMENTS

| | | | |
|---|---|---|---|
| 5,150,636 | A | 9/1992 | Hill |
| 5,453,105 | A | 9/1995 | Middlemiss et al. |
| 5,706,906 | A | 1/1998 | Jurewicz et al. |
| 6,179,886 | B1 | 1/2001 | Gordeev et al. |
| 6,202,770 | B1 | 3/2001 | Jurewicz et al. |
| 6,447,852 | B1 | 9/2002 | Gordeev et al. |
| 6,709,747 | B1 | 3/2004 | Gordeev et al. |
| 6,919,040 | B2 | 7/2005 | Fries et al. |
| 7,008,672 | B2 | 3/2006 | Gordeev et al. |
| 2006/0055229 | A1 | 3/2006 | Stehney |
| 2008/0035383 | A1 | 2/2008 | Hall et al. |
| 2008/0169698 | A1 | 7/2008 | Hall et al. |
| 2009/0051211 | A1 | 2/2009 | Hall et al. |
| 2011/0132667 | A1 | 6/2011 | Smallman et al. |

FOREIGN PATENT DOCUMENTS

| | | | |
|---|---|---|---|
| FR | 1534067 | A | 7/1968 |
| GB | 529937 | A | 12/1940 |
| GB | 839047 | A | 6/1960 |
| GB | 2170843 | A | 8/1986 |
| GB | 2177144 | A | 1/1987 |
| GB | 2273513 | A | 6/1994 |
| GB | 2193740 | A | 2/1998 |
| WO | 00/20722 | A2 | 4/2000 |
| WO | 2005/093214 | A1 | 10/2005 |
| WO | 2008/105915 | A2 | 9/2008 |
| WO | 2009/013713 | A2 | 1/2009 |
| WO | 2009/053903 | A2 | 4/2009 |
| WO | 2010/083015 | A1 | 7/2010 |

OTHER PUBLICATIONS

Search Report for GB1317015.4 dated Mar. 21, 2014.
International Search Report for PCT/EP2013/070001 dated Oct. 31, 2014.

PICK TOOL HAVING A SUPER-HARD PLANAR STRIKE SURFACE

CROSS REFERENCE TO RELATED APPLICATIONS

This application is the U.S. national phase of International Application No. PCT/EP2013/070001 filed on Sep. 25, 2013, and published in English on Apr. 3, 2014 as International Publication No. WO 2014/049010 A2, which application claims priority to Great Britain Patent Application No. 1217433.0 filed on Sep. 28, 2012, U.S. Provisional Application No. 61/707,309 filed on Sep. 28, 2012, U.S. Provisional Application No. 61/718,093 filed on Oct. 24, 2012, and Great Britain Patent Application No. 1219082.3 filed on Oct. 24, 2012, the contents of all of which are incorporated herein by reference.

This disclosure relates generally to super-hard strike members for pick tools, assemblies comprising same and methods for making same, particularly but not exclusively for road milling or mining.

International patent application publication number WO/2008/105915 discloses a high impact resistant tool which has a super-hard material bonded to a cemented metal carbide substrate at a non-planar interface. At the interface, the substrate has a tapered surface starting from a cylindrical rim of the substrate and ending at an elevated flatted central region formed in the substrate. The super-hard material has a pointed geometry with a sharp apex having 1.27 to 3.17 millimeters radius. The super-hard material also has a 2.54 to 12.7 millimeter thickness from the apex to the flatted central region of the substrate. In other embodiments, the substrate may have a non-planar interface.

International patent application publication number WO/2010/083015 discloses a non-rotating mining cutter pick comprising a shank portion with a non-circular cross-section, a head portion including a tip region distal from the shank portion, a shoulder portion separating the shank portion from the head portion, and a cutting insert mounted at a front end of the tip region. The cutting insert includes a body formed of tungsten carbide and an element formed of a super-hard material, wherein the element formed of the super-hard material is fused to the body, and wherein at least a portion of a first surface of the element formed of the super-hard material is exposed on a cutting surface of the cutting insert.

United Kingdom patent application number 2 170 843 A discloses a cutting tool for a mining machine comprising a holding lug having one end adapted for mounting in a surface such as the surface of a drum and an opposite working end, and an insert bonded to the working end of the lug and presenting a working face of abrasive compact which provides a cutting edge for the tool. The working end of the lug to which the insert is bonded lies entirely behind the compact working face.

There is a need for a pick tool comprising a super-hard tip having high resistance to wear and fracture.

Viewed from a first aspect there is provided a strike member joined to pick body, the strike member comprising a strike member non-moveably attached to a pick body, the strike member comprising a strike structure; in which the strike structure comprises super-hard material and defines a planar strike surface, the strike surface defining a cutting edge that includes an apex in the plane of the strike surface; in which the thickness of at least a proximate volume of the strike structure adjacent the cutting edge is at least about 2 millimeters, at least 2.5 millimeters, at least 3 millimeters or at least 4 millimeters, the thickness being from the strike surface to an opposite boundary of the strike structure Various combinations and arrangements of strike members and pick tools are envisaged by the disclosure, of which the following are non-limiting and non-exhaustive examples that may be used in combination with one or more of each other.

In some example arrangements, the thickness of the proximate volume may be at least about 2 millimeters, at least 2.5 millimeters, at least 3 millimeters or at least 4 millimeters along substantially the entire cutting edge. In some example arrangements, the thickness of the proximate volume or of the entire strike structure may be at most about 8 millimeters, at most about 6 millimeters or at most about 4 millimeters.

In some example arrangements, the strike structure may be in the form of a layer comprising the super-hard material, which may be joined to a substrate, the layer having a mean thickness of at least 2 millimeters, at least 2.5 millimeters, at least 3 millimeters or at least 4 millimeters. In some example arrangements, the strike structure may be in the form of a layer joined to a cemented carbide substrate.

In some example arrangements, the thickness of the proximate volume may be substantially greater than the thickness of a distal volume of the strike structure remote from the cutting edge.

In some example arrangements, the proximate volume may extend at least about 2 millimeters or at least about 4 millimeters from the cutting edge in a direction parallel to the strike surface, or the proximate volume may extend from the cutting edge to an opposite edge of the strike surface.

In some example arrangements, the cutting edge may be radiused or chamfered.

The strike member and the pick body may be configured such that the cutting edge projects from a proximate end of the pick body, thus being exposed operative to cut a body to be degraded. In some example arrangements, the pick body may comprise a shank at a distal end, configured for attachment to a base mounted on a drive apparatus.

In some example arrangements, the cutting edge may include substantially linear opposite edge segments (or portions) diverging from the apex. In various example arrangements, the apex may be arcuate, substantially pointed or substantially linear in the plane of the strike surface (in a linear apex, a line of points will protrude substantially equidistant from the pick body).

In some example arrangements, opposite ends of the cutting edge may be directly spaced apart by a first distance and the length of the cutting edge between the ends is a second distance; the strike member configured such that the ratio of the second distance to the first distance may be at least about 1.05 and or at most about 1.5.

In some example arrangements, the super-hard material may comprise or consist of polycrystalline diamond (PCD) material, polycrystalline cubic boron nitride (PCBN) material or silicon carbide bonded diamond (SCD) material.

In some example arrangements, the strike structure may comprise PCD material, at least a region of which adjacent the cutting edge contains voids between diamond grains comprised in the PCD material (for example, filler material may have been removed by means of acid leaching). The PCD material in the region may contain less than about 2 weight percent filler material.

In some example arrangements, the strike structure may comprise PCD material, at least a region of which adjacent the cutting edge may consist of PCD material containing filler material within interstices between diamond grains, the content of the filler material being greater than 5 weight percent of the PCD material in the region. For example, the filler material may comprise catalyst material for diamond, such as cobalt.

In some example arrangements, the strike structure may consist substantially of a single grade of PCD or it may comprise a plurality of PCD grades arranged in various ways, such as in layered or lamination arrangements. For example, the strike structure may comprise a plurality of grades of PCD material arranged as strata in a layered configuration, adjacent strata being directly bonded to each other by inter-growth of diamond grains (i.e. by direct inter-bonding of diamond grains).

In some example arrangements, the substrate may comprise an intermediate substrate volume and a distal volume, the intermediate substrate volume being disposed between the super-hard structure and a distal substrate volume. The intermediate substrate volume may comprise an intermediate material having a mean Young's modulus at least 60 percent that of the super-hard material.

In some example arrangements, the strike member may be attached non-moveably to a pick body and the pick tool may be configured for non-rotatable mounting onto a cooperatively configured carrier apparatus.

The pick tool may be for a road milling or mining apparatus.

Viewed from a second aspect, there is provided an assembly comprising a pick tool according to this disclosure and a carrier apparatus, the pick tool and the carrier apparatus being cooperatively configured such that the pick tool can be non-rotatably attached to the carrier apparatus. The carrier apparatus may comprise a drum for a road milling or mining apparatus.

Viewed from a third aspect, there is provided a method for making a pick tool according to this disclosure, the method including providing a construction, such as a disc, comprising a layer of super-hard material joined to a substrate, the super-hard material defining a substantially planar surface of the disc; the layer including at least one region in which the thickness of the layer from the planar surface to an opposite boundary of the layer is at least about 2 millimeters; cutting a segment from the construction, the segment having a substantially planar segment surface defined by the super-hard material, the segment surface defining an edge including an apex in the plane of the segment surface; the segment cut from the construction such that the apex is cut from the region and the thickness of a proximate volume of the super-hard material adjacent the apex is at least about 2 millimeters; processing the segment to provide the strike member, in which the cutting edge is formed from the edge of the segment; and attaching the strike member to the pick body such that the strike member is not capable of moving relative to the pick body.

In some examples, the method may include cutting a plurality of segments from the construction and processing the segments to provide a plurality of strike members.

In some examples, the super-hard material may comprise PCD material, and in some examples, the layer of super-hard material may have a mean thickness of at least about 2 millimeters, at least 2.5 millimeters, at least about 3 millimeters or at least about 4 millimeters. The thickness of the super-hard layer may be at most about 8 millimeters, at most about 6 millimeters or at most about 4 millimeters.

In some example arrangements, the super-hard material may comprise or consist of polycrystalline diamond (PCD) material, polycrystalline cubic boron nitride (PCBN) material or silicon carbide bonded diamond (SCD) material.

In some examples, the method may include providing an aggregation comprising a plurality of diamond grains and a source of catalyst material for promoting the inter-growth of the diamond grains, forming the aggregation into a pre-sinter structure and subjecting the pre-sinter structure to a pressure and temperature at which the diamond grains are capable of inter-growth in the presence of the catalyst material to provide a construction comprising polycrystalline diamond material.

In various examples, the source of catalyst material may be in the form grains dispersed within the aggregation, as a blended powder, or in the form of coating on the diamond grains or particulates attached to the diamond grains. The source of catalyst material may comprise the catalyst material or precursor material from which catalyst material can be obtained. For example, the source of catalyst material may comprise or consist of cobalt or a chemical compound including cobalt. In some examples, the method may include treating the aggregation, by heating for example, to provide catalyst material from precursor material.

In some examples, the method may include contacting the aggregation with a substrate comprising cemented tungsten carbide.

In some examples, the method may include forming a radius or chamfer on the cutting edge.

In some examples, the thickness of the entire layer may be at least about 2 millimeters.

In some examples, the substrate may include a depression and the thickness of the layer of the super-hard material in a region adjacent the depression may be at least about 2 millimeters.

Non-limiting example arrangements to illustrate the present disclosure are described hereafter with reference to the accompanying drawings, of which:

Figure 1:
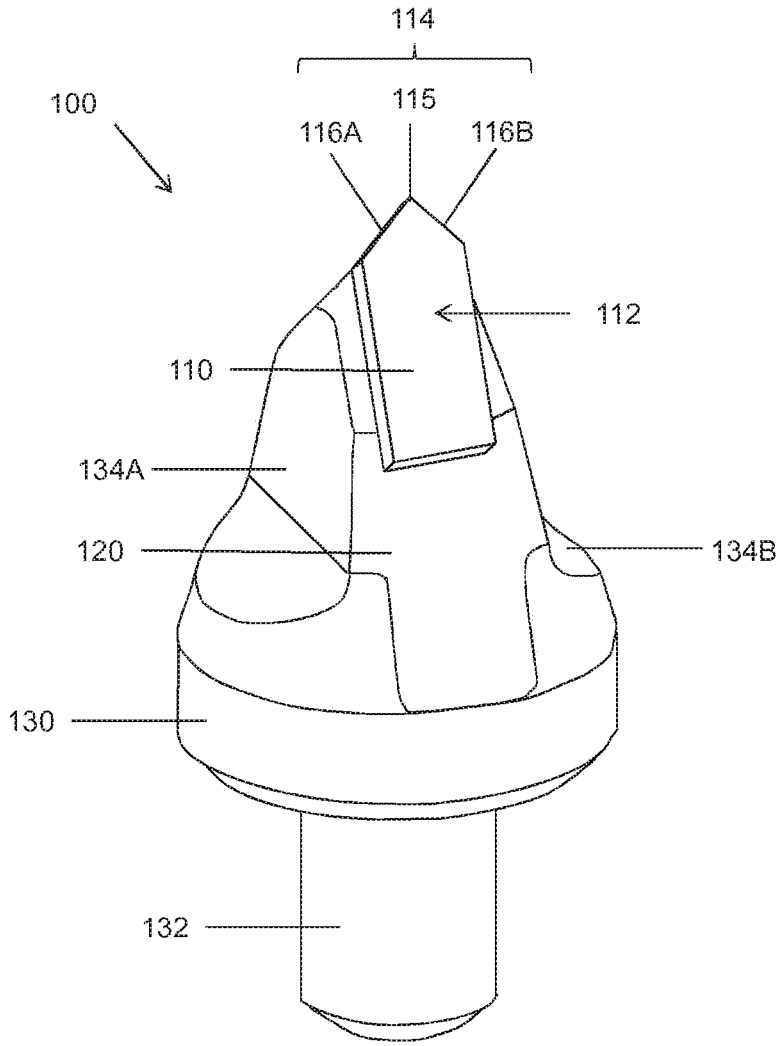
FIG. 1 and FIG. 2 show schematic perspective views of example pick tools.
Figure 2:
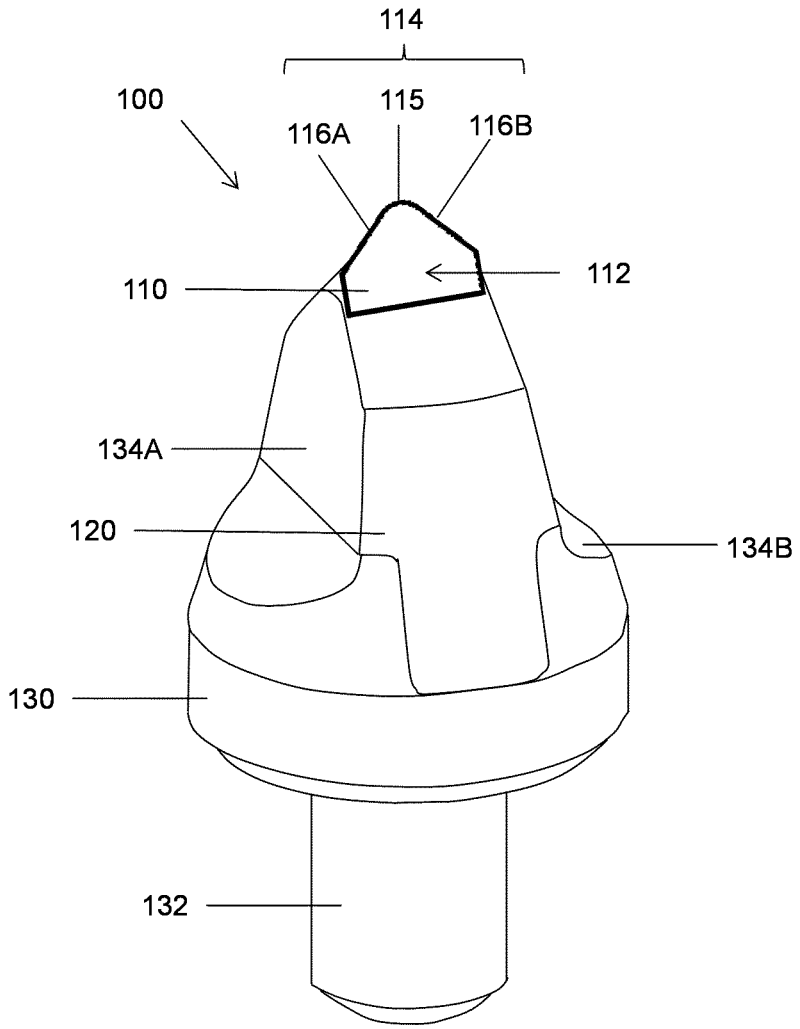

With reference to FIG. 1 and FIG. 2, example pick tools 100 each comprise a strike member 110 brazed to a respective cemented carbide support body 120, which is brazed to a respective steel base 130. The steel base 130 comprises a shank 132 for coupling the pick tool 100 to a base block (not shown) attached to a road milling drum or other carrier apparatus for road milling or mining (not shown). The shank 132 is at the opposite end of the pick tool 100 to a cutting edge 114 of the strike member 110. The coupling mechanism between the pick tool 100 and the carrier apparatus will be configured such that the pick tool 100 will not be able to rotate relative to the carrier apparatus in use, thus ensuring that a strike surface 112 and the cutting edge 114 will remain in a suitable orientation for cutting the body to be degraded in use. In the particular example arrangement shown in FIG. 1, the pick tool 100 is configured to present a pair of generally concave lateral surfaces 134A, 134B on opposite sides of the strike member 110 in order to reduce the amount of cemented carbide material comprised in the pick tool 100. The concave lateral surfaces 134A, 134B are formed partly by the steel base 130 and partly by the cemented carbide support body 120.

In these examples, the strike member 110 comprises a layer of polycrystalline diamond (PCD) material joined to a cemented carbide substrate (the substrates are not visible in FIG. 1 or FIG. 2 since they are located within respective depressions formed within the support bodies 120. In these examples, the PCD layer is about 2 to about 2.5 millimeters thick. A substantially planar strike surface 112 is defined by a major exposed surface of the PCD material opposite an interface boundary with the substrate. The strike surface 112 defines a cutting edge 114 projected furthest beyond the pick body 120, such that it can cut into a body to be degraded (not shown) in use. The cutting edge 114 includes an apex 115 in the plane of the strike surface 112. In the particular example illustrated in FIG. 1, the apex 115 is substantially pointed, forming a vertex between a pair of substantially straight and diverging portions 116A, 116B of the cutting edge 114.

Figure 3:
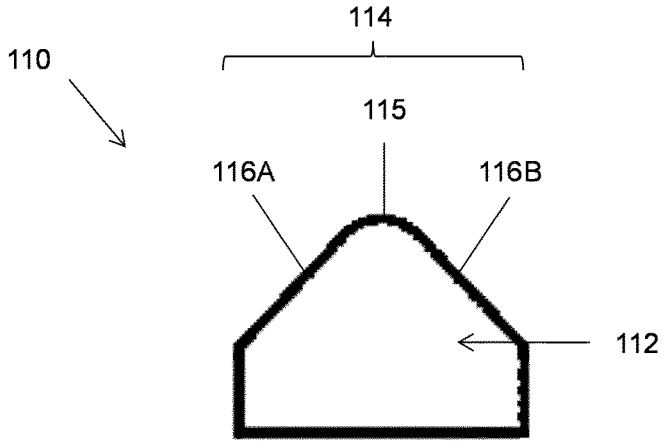
FIG. 3 and FIG. 4 show schematic plan views of example strike members.

With particular reference to FIG. 2 and FIG. 3, the apexes 115 of example strike members 110 may be curved in the plane of the strike surface 112, forming an arcuate transition between respective pairs of substantially straight and diverging portions 116A, 116B of the respective cutting edges 114. The area of the strike surface 112 is substantially less than that of the example shown in FIG. 1, which is likely to have the aspect of reducing the cost of the pick tool 100, since PCD material is more costly to provide than cemented carbide material.

Figure 4:
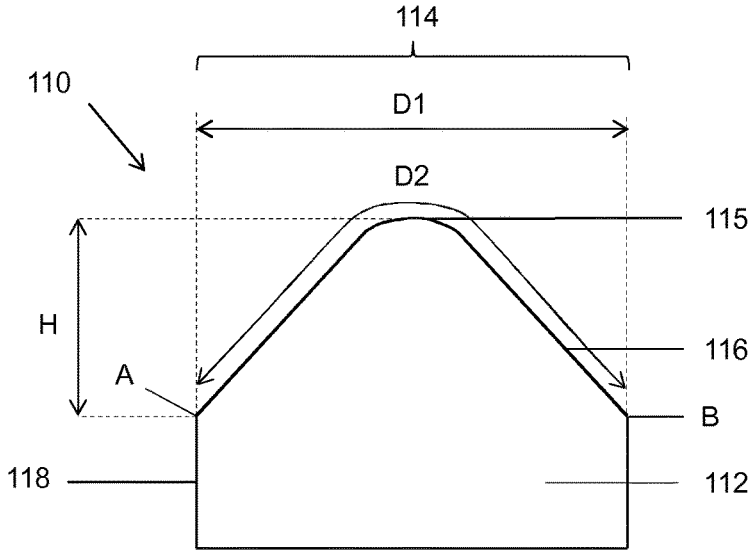

With particular reference to FIG. 4, the cutting edge of an example strike member 110 includes the apex 115 and edge portions 116 on opposite sides of the apex 115, the edge 114 extending between points A, B on opposite sides of the strike member 110, when viewed in a plan view. The opposite ends A, B of the cutting edge 114 are directly spaced apart by a first distance D1 and the length of the cutting edge 114 is a second distance D2. In some examples, the strike member 110 may be configured such that the ratio of the second distance D2 to the first distance D1 may be at least about 1.05 and or at most about 1.5. This is likely to achieve a suitable balance between the lateral and longitudinal extents of the cutting edge, and consequently a balance between cutting or digging efficiency on the one hand and resistance to fracture on the other hand.

Figure 5:
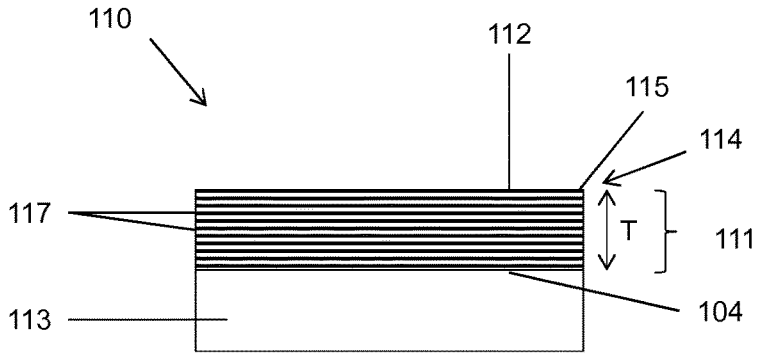
FIG. 5, FIG. 6, FIG. 7 and FIG. 8 show schematic cross section views of example strike members.

With particular reference to FIG. 5, an example strike member 110 comprises a strike structure 111 consisting of PCD material, joined to a cemented carbide substrate 113, the PCD strike structure 111 defining a flat strike surface 112 opposite a boundary 104 of the PCD strike structure 111 with the substrate 113. In this particular example, the PCD strike structure 111 comprises a plurality of layers 117, in which consecutive layers 117 comprise different grades of PCD material arranged alternately. In this example, the layers 117 are arranged generally parallel to the strike surface 112, although other arrangements may be used in other examples. Each of the layers 117 may have a thickness in the range of around 30 to 300 microns. In this example, the overall thickness T of the PCD strike structure 111, measured from the strike surface 112 to the opposite boundary 104 of the strike structure 111 is about 3 millimeters. In this example, the boundary 104 of the strike structure 111 at the interface with the substrate 113 is substantially planar and parallel to the strike surface 112 and the thickness T of the strike structure 111 is substantially uniform across the strike structure 111. The apex 115 and cutting edge 114 are also indicated in the drawing.

Figure 6:
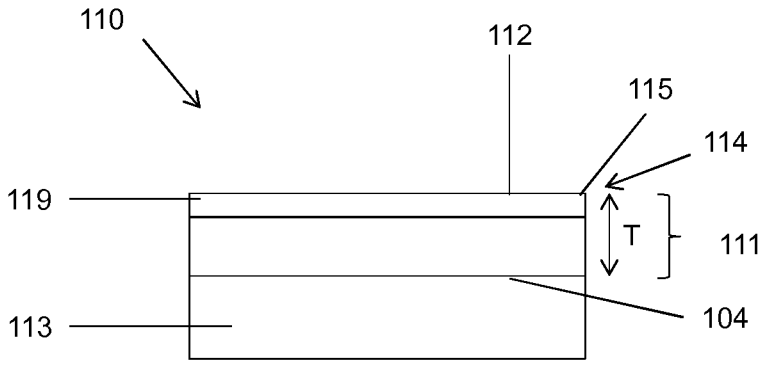

With particular reference to FIG. 6, an example strike member 110 comprises a PCD strike structure 111 joined to a cemented carbide substrate 113, the PCD strike structure defining a flat strike surface 112 opposite a boundary 104 of the PCD strike structure 111 with the substrate 113. In this particular example, the PCD strike structure 111 comprises a volume 119 adjacent the strike surface 112 (and remote from the substrate 113), including voids between the diamond grains. In some examples, the volume 119 may extend to a depth of at least about 50 microns to about 400 microns from the strike surface 112. The voids may be created by removing filler material by means of treatment in acid, for example. In this example, the overall thickness T of the PCD strike structure 111, measured from the strike surface 112 to the opposite boundary 104 of the strike structure 111 is about 3 millimeters. In this example, the boundary 104 of the strike structure 111 at the interface with the substrate 113 is substantially planar and parallel to the strike surface 112 and the thickness T of the strike structure 111 is substantially uniform across the strike structure 111. The apex 115 and cutting edge 114 are also indicated in the drawing.

Figure 7:
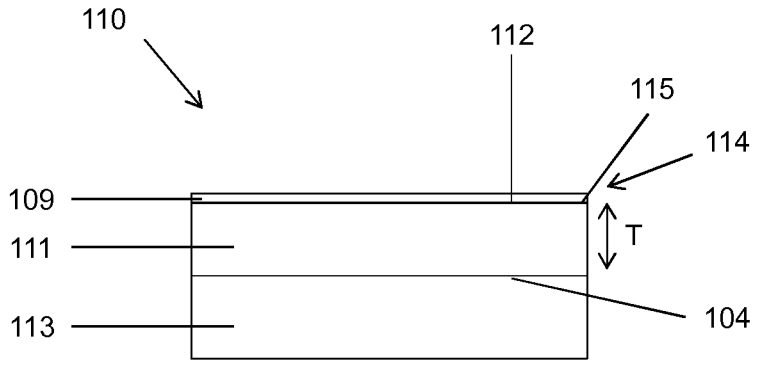

With particular reference to FIG. 7, an example strike member 110 comprises a PCD strike structure 111 joined to a cemented carbide substrate 113, the PCD strike structure defining a flat strike surface 112 opposite a boundary 104 of the PCD strike structure 111 with the substrate 113. In this particular example, the strike member 110 comprises a protective layer 109 of material that is substantially softer than the PCD strike structure 111, the protective layer 109 bonded to the strike surface 112 of the PCD strike structure 111. The protective layer 119 may have a thickness of at least about 10 microns or at least about 50 microns and at most about 200 microns. The protective layer 109 may comprise material from a jacket or capsule within which the PCD material was contained during the process of sintering the PCD material at an ultra-high pressure (e.g. at least about 5.5 GPa) and high temperature (e.g. at least about 1,250 degrees Celsius). In various examples, the protective layer may comprise refractory metal such as tungsten (W), molybdenum (Mo), niobium (Nb) or tantalum (Ta). The protective layer may itself be formed of sub-layers. For example, a sub-layer comprising metal carbide may be joined to the PCD strike structure and a sub-layer comprising the metal in elemental or non-carbide alloy form may be present over the sub-layer. The sub-layer comprising the metal carbide may arise from chemical reaction between the metal and carbon from the diamond in the aggregation from which the PCD material was sintered, or from the PCD material. In other examples, the protective layer 109 may be deposited onto the PCD strike structure 111 after the sintering process, for example by means of chemical vapour deposition (CVD) or physical vapour deposition (PVD). The thickness T of the PCD strike structure 111, measured from the strike surface 112 and the opposite boundary 104 of the strike structure 111 is about 3 millimeters. In this example, the boundary 104 of the strike structure 111 at the interface with the substrate 113 is substantially planar and parallel to the strike surface 112 and the thickness T of the strike structure 111 is substantially uniform across the strike structure 111. The apex 115 and cutting edge 114 are also indicated in the drawing.

Figure 8:
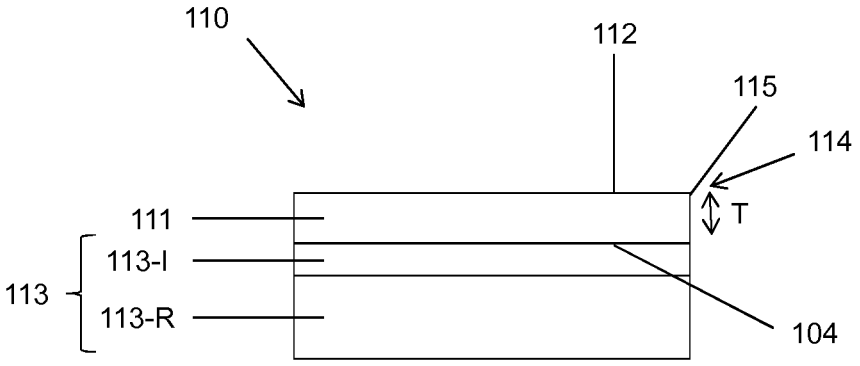

With particular reference to FIG. 8, an example strike member 110 comprises a strike structure 111 consisting of PCD material, joined to a cemented carbide substrate 113, the PCD strike structure defining a flat strike surface 112 opposite a boundary 104 of the PCD strike structure 111 with the substrate 113. In this particular example, the substrate 113 comprises an intermediate substrate volume 113-I and a distal volume 113-R, the intermediate substrate volume 113-I disposed between the PCD strike structure 111 and a distal substrate volume 113-R. In some examples, the intermediate substrate volume 113-I may be greater than the volume of the PCD strike structure 111, or the intermediate substrate volume 113-I may be less than the volume of the PCD strike structure 111. The intermediate substrate volume 113-I comprises an intermediate material having a mean Young's modulus at least 60 percent that of the super-hard structure 111. The intermediate substrate volume 113-I has stiffness that is intermediate that of the PCD strike structure 111 and the distal substrate volume 113-R of the substrate 113 and may comprise a material having a Young's modulus of at least about 650 GPa and at most about 900 GPa. In a particular example, the intermediate substrate volume 113-I comprises carbide grains and diamond grains and the Young's modulus of the strike structure 111 is at least about 1,000 GPa. The thickness T of the PCD strike structure 111, measured from the strike surface 112 to the opposite boundary 104 of the strike structure 111 with the intermediate substrate volume 113-I may be about 2 millimeters. In this example, the boundary 104 of the strike structure 111 at the interface with the substrate 113 is substantially planar and parallel to the strike surface 112 and the thickness T of the strike structure 111 is substantially uniform across the strike structure 111. The apex 115 and cutting edge 114 are also indicated in the drawing.

Figure 9:
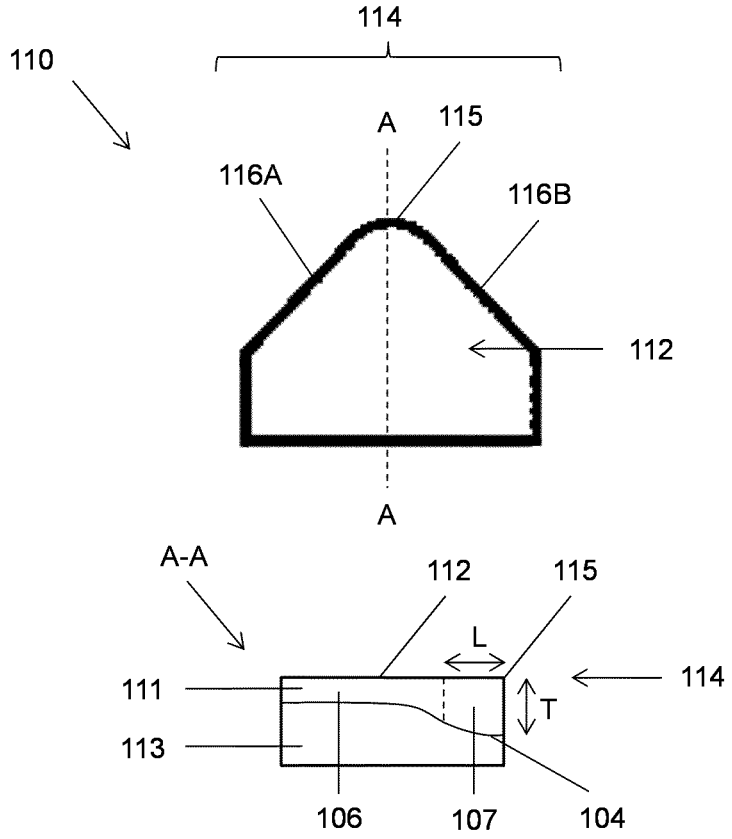
FIG. 9 shows a schematic cross section view (lower drawing) through a section A-A of an example strike member, shown in plan view (upper drawing)

FIG. 9 shows an example strike member 110 schematically in plan view (upper drawing) and in cross section view (lower drawing) corresponding to the A-A. The strike structure 111 consists of PCD material and is bonded to a substrate 103 at a boundary 104 of the strike structure 111. The apex 115 is curved in the plane of the strike surface 112, forming an arcuate transition between a pair of substantially straight and diverging portions 116A, 116B of the cutting edge 114. In this example, the boundary 104 of the PCD strike structure 111 is not planar across its entire extent and includes a projection deeper into the substrate 113 adjacent the cutting edge 114 (there is a corresponding depression in the substrate 113). A proximate volume 107 of the strike structure 111 is thus provided adjacent the cutting edge 114, the thickness T of the proximate volume 107 being about 3 millimeters. A distal volume 106 remote from the cutting edge 114 has a thickness of about 2 millimeters. The proximate volume 107 extends from the cutting edge 114 a distance L of about 3 millimeters parallel to the strike surface 112.

Figure 10:
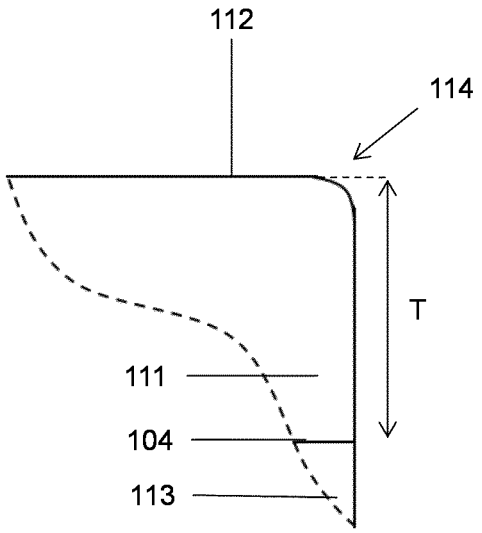
FIG. 10 and FIG. 11 show schematic cross section views of part of example strike members adjacent cutting edges.
Figure 11:
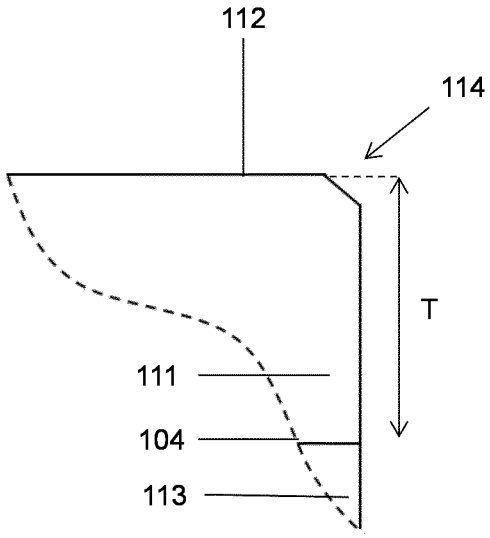

FIG. 10 and FIG. 11 show parts of strike members adjacent the respective cutting edges 114. In each drawing, the strike structure 111 consists of PCD material and is joined to a cemented carbide substrate 113 at a boundary 104 of the strike structure 111. The thickness T of the strike structure 111 adjacent the cutting edge 114 is about 2.5 millimeters, the cutting edge 114 being defined by the strike surface 112. In the example shown in FIG. 10, the cutting edge 114 is honed (rounded) and in the example shown in FIG. 11, the cutting edge 114 is chamfered.

A method of making strike members will be described with reference to FIG. 12A, FIG. 12B and FIG. 12C. The example method includes cutting out a plurality of segments 310 from a disc 200 and processing each segment to provide respective finished strike members. In this example, the disc 200 is circular with a diameter of about 70 millimeters and comprises a layer 211 of PCD material formed joined to a cemented carbide substrate 213 (as used herein, the phrase "formed joined" means that the PCD material becomes bonded to the substrate in the same step in which the PCD material is formed by sintering together diamond grains, an example of which process will be described below). In a particular example, the PCD layer 211 may be about 2 to about 2.5 millimeters thick. In other examples it may be substantially thicker, relatively thicker PCD layers 211 being expected to be more resistant to fracture, all else being equal. The disc 200 has a pair of planar opposite major end surfaces connected by a peripheral side 218, one of the major surfaces 212 being defined by the PCD material.

Figure 12A:
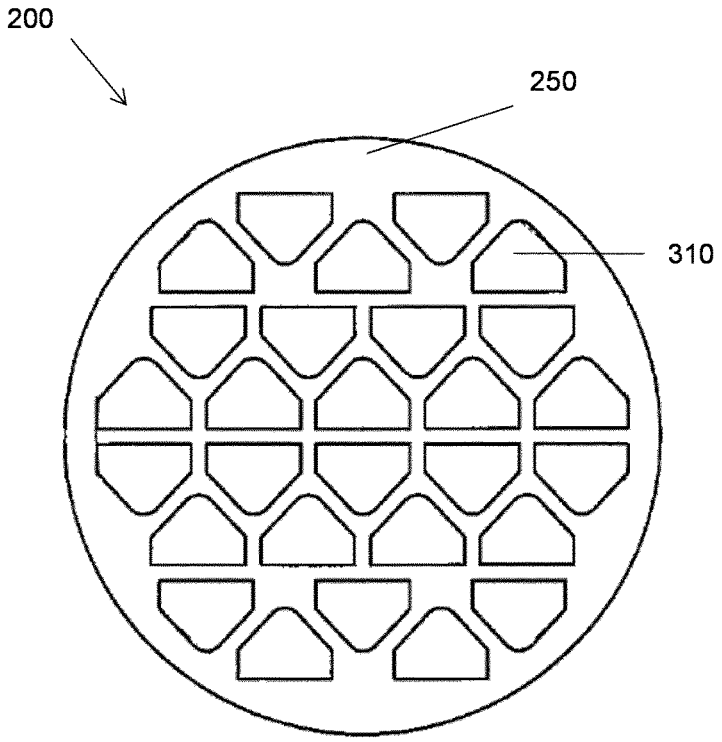
FIG. 12A shows a schematic plan view of a super-hard disc and the outlines of example segments for strike tips to be cut from it.
Figure 12B:
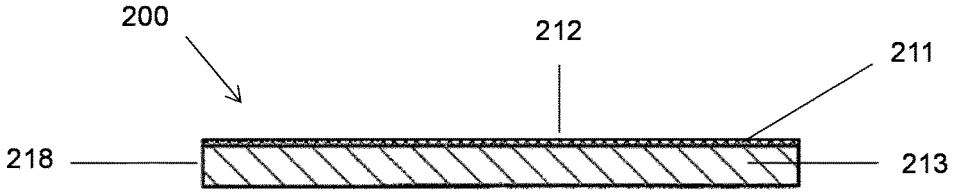
FIG. 12B shows a schematic plan cross section view through the disc and FIG. 12C shows a schematic plan view of a segment for a strike member.

With reference to FIG. 12A, a plurality of segments 310 may be cut from the disc 200, leaving a scrap structure 220. In order to reduce the volume of the scrap structure 250, a predetermined cutting arrangement may be configured such that as many segments 310 as possible can be cut from the disc 200.

Figure 12C:
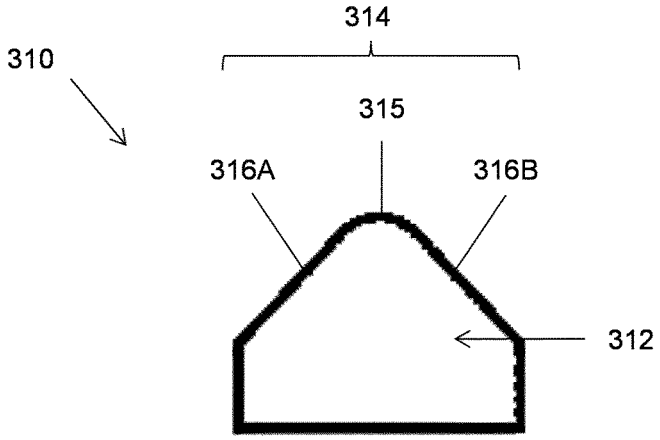

A example cut segment 310 is shown in FIG. 12C. The cut segments 310 will be configured substantially as the intended strike member. For example, at least some of the segments 310 may be alternately arranged such that each apex 315 is located between the apexes of segments on either side of it. The segments 310 may be cut by means of electro-discharge machining (EDM), which involves moving an electrically conducting wire through the disc (the wire extending perpendicular to the disc). Other methods for cutting PCD material may also be used. Each cut segment 310 can then be processed by grinding, for example, to final dimensions, tolerance and surface finish to form respective finished strike members. An edge 314 including an apex 315 of each segment 310 may be chamfered or radiused to form the respective cutting edge of the respective strike member.

Figure 13:
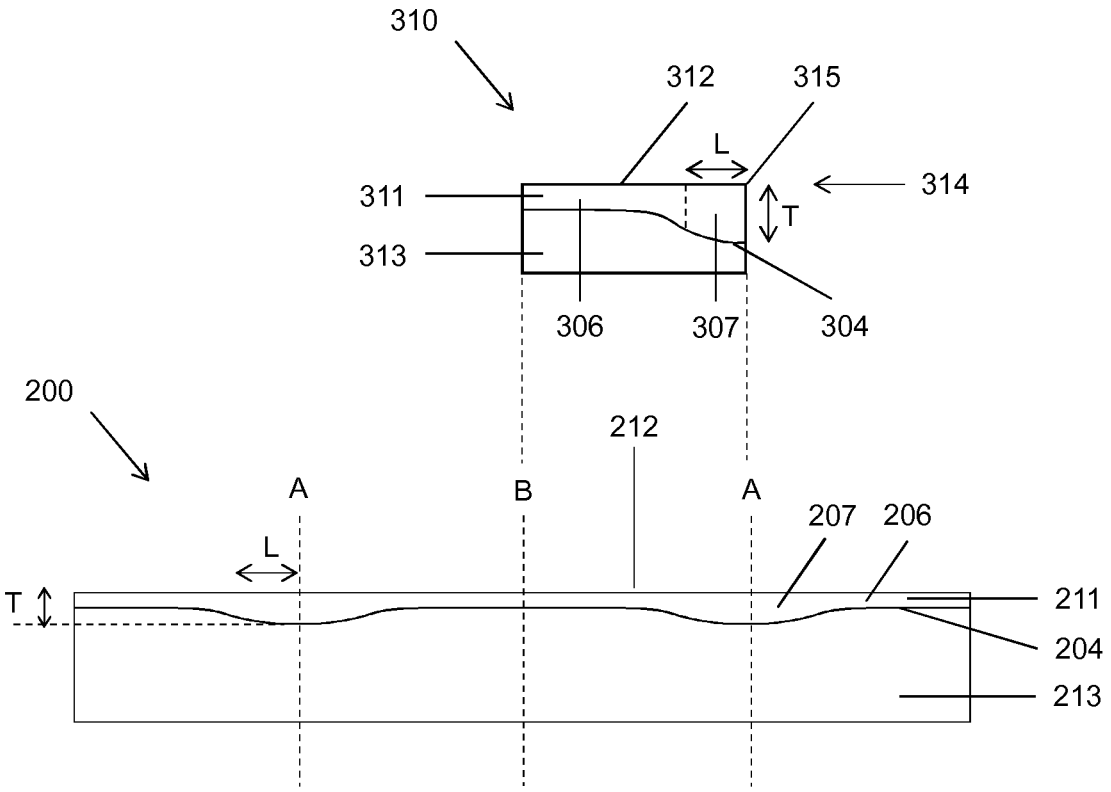
FIG. 13 shows a schematic cross section view through an example disc from which an example segment for making a strike member can be cut.

An example method of making a plurality of strike structures will be described with reference to FIG. 13. A disc construction 200 may be provided, comprising a layer 211 consisting of PCD material joined at a boundary 204 of the layer 211 to a substrate 213 comprising cemented tungsten carbide material. The PCD layer 211 defines a substantially planar surface 212 of the disc 200 opposite the non-planar boundary 204. The layer 211 includes first regions 207, in which the thickness T of the layer 211 from the planar surface 212 to the opposite boundary 204 of the layer 211 is about 3 millimeters. In this example, the layer 211 includes second regions 206, in which the thickness of the layer 211 is about 2 millimeters. The method includes cutting a segment 310 (or a plurality of segments 310) from the disc 300, the segment 310 having a substantially planar segment surface 312 defined by the super-hard material, the segment surface 312 defining an edge 314 including an apex 315 in the plane of the segment surface 312. The segment 310 is cut from the disc 200 such that the apex 315 is cut from the first region 207, the apex 315 corresponding to the line A through the disc 200 and an end of the segment 310 opposite the apex 315 corresponding to a plane B through the second region 206 of the disc 200.

In general, a PCD disc can be made by placing an aggregation comprising a plurality of diamond grains onto a cemented carbide substrate disc and subjecting the resulting pre-sinter assembly in the presence of a catalyst material for diamond to an ultra-high pressure and high temperature at which diamond is more thermodynamically stable than graphite, to sinter together the diamond grains and form a PCD layer joined to the substrate disc. Binder material within the cemented carbide substrate may provide a source of the catalyst material, such as cobalt, iron or nickel, or mixtures or alloys including any of these. A source of catalyst material may be provided within the aggregation of diamond grains, in the form of admixed powder or deposits on the diamond grains, for example. A source of catalyst material may be provided proximate a boundary of the aggregation other than the boundary between the aggregation and the substrate body, for example adjacent a boundary of the aggregation that will correspond to the strike end of the sintered PCD strike structure. Methods in which the catalyst material for diamond (and or precursor material for catalyst material) is comprised in the aggregation are likely to have the aspect that relatively thicker layers of PCD can be made. In examples where the source of catalyst material is comprised in the substrate but not in the aggregation, the practically achievable thickness of the PCD layer is likely to be limited by the infiltration of the molten catalyst material through the aggregation, since the catalyst material may not infiltrate uniformly through the aggregation.

In some methods, the aggregation of diamond grains may include precursor material for catalyst material. For example, the aggregation may include metal carbonate precursor material, in particular metal carbonate crystals, and the method may include converting the binder precursor material to the corresponding metal oxide (for example, by pyrolysis or decomposition), admixing the metal oxide based binder precursor material with a mass of diamond particles, and milling the mixture to produce metal oxide precursor material dispersed over the surfaces of the diamond particles. The metal carbonate crystals may be selected from cobalt carbonate, nickel carbonate, copper carbonate and the like, in particular cobalt carbonate. The catalyst precursor material may be milled until the mean particle size of the metal oxide is in the range from about 5 nm to about 200 nm. The metal oxide may be reduced to a metal dispersion, for example in a vacuum in the presence of carbon and/or by hydrogen reduction. The controlled pyrolysis of a metal carbonate, such as cobalt carbonate crystals provides a method for producing the corresponding metal oxide, for example cobalt oxide ($Co_3O_4$), which can be reduced to form cobalt metal dispersions. The reduction of the oxide may be carried out in a vacuum in the presence of carbon and/or by hydrogen reduction.

A disc construction 200 can be provided by providing an aggregation comprising a plurality of diamond grains and a source of cobalt, and contacting the aggregation with a surface of a cemented carbide substrate to provide a pre-sinter assembly. The surface of the substrate may include a plurality of depressions to correspond to the first regions 207 of the sintered PCD layer. The pre-sinter assembly is subjected to a pressure and temperature suitable for sintering diamond grains directly together to provide the PCD layer bonded to the substrate.

In some example methods, the aggregation may comprise substantially loose diamond grains, or diamond grains held together by a binder material. The aggregations may be in the form of granules, discs, wafers or sheets, and may contain catalyst material for diamond, such as cobalt, and or additives for reducing abnormal diamond grain growth, for example, or the aggregation may be substantially free of catalyst material or additives.

In some example methods, aggregations in the form of sheets comprising a plurality of diamond grains held together by a binder material may be provided. The sheets may be made by a method such as extrusion or tape casting, in which slurries comprising diamond grains having respective size distributions suitable for making the desired respective PCD grades, and a binder material is spread onto a surface and allowed to dry. Other methods for making diamond-containing sheets may also be used, such as described in U.S. Pat. Nos. 5,766,394 and 6,446,740. Alternative methods for depositing diamond-bearing layers include spraying methods, such as thermal spraying. The binder material may comprise a water-based organic binder such as methyl cellulose or polyethylene glycol (PEG) and different sheets comprising diamond grains having different size distributions, diamond content and or additives may be provided. For example, sheets comprising diamond grains having a mean size in the range from about 15 microns to about 80 microns may be provided. Discs may be cut from the sheet or the sheet may be fragmented. The sheets may also contain catalyst material for diamond, such as cobalt, and or precursor material for the catalyst material, and or additives for inhibiting abnormal growth of the diamond grains or enhancing the properties of the PCD material. For example, the sheets may contain about 0.5 weight percent to about 5 weight percent of vanadium carbide, chromium carbide or tungsten carbide.

A substrate body comprising cemented carbide in which the cement or binder material comprises a catalyst material for diamond, such as cobalt, may be provided. The substrate body may have a non-planar or a substantially planar proximate end on which the PCD strike structure is to be formed. For example, the proximate end may be configured to reduce or at least modify residual stress within the PCD. A cup, jacket or canister having a generally conical internal surface may be provided for use in assembling the diamond aggregation, which may be in the form of an assembly of diamond-containing sheets, onto the substrate body. The aggregation may be placed into the cup and arranged to fit substantially conformally against the internal surface. The substrate body may then be inserted into the cup with the proximate end going in first and pushed against the aggregation of diamond grains. The substrate body may be firmly held against the aggregation by means of a second cup placed over it and inter-engaging or joining with the first cup to form a pre-sinter assembly.

The pre-sinter assembly comprising the aggregation layer placed against a major surface of the substrate disc can be placed into a capsule for an ultra-high pressure press. The pre-sinter assembly is then subjected to an ultra-high pressure of at least about 5.5 GPa and a temperature of at least about 1,300 degrees centigrade to sinter the diamond grains and form a construction comprising a PCD strike structure sintered onto the substrate body.

A segment can then be processed, including for example forming a chamfer or hone on the cutting edge, to provide a strike member in which the cutting edge is formed from the edge of the segment. The strike member can then be attached to a pick body.

Each finished strike member may be joined to a pick body by means of braze material. A layer of suitable braze material may be placed in contact with and between the substrate of the strike member and an area of the pick body that is configured for accommodating the strike member, the braze alloy heated to above its melting point and then cooled to provide a braze layer bonded to the strike member on one side and the pick body on the other side. Strike members comprising thermally stable PCD or other thermally stable super-hard material such as polycrystalline cubic boron nitride (PCBN) or silicon carbide bonded diamond (SCD) are likely to be relatively more resilient against thermal degradation during brazing.

In some examples, the strike member and the pick body may be cooperatively configured such that the strike member may be attached to the pick body by mechanical means. For example, a tongue-and-groove type mechanism may be used, or the sides of the strike member may dove-tail with corresponding flange structures formed on the sides of a depression formed into the pick body. In some examples, a combination of brazing and mechanical means may be used.

In examples where strike members are used to break up bodies comprising hard structures (such as stones) dispersed within a softer matrix structure, the configuration of the strike member in general and the cutting edge in particular may be selected according to the composition of the body. For example, picks comprising strike member according to this disclosure may be used to break up road or pavement bodies comprising asphalt, which may comprise grains of stones dispersed with in a tar-based matrix.

Figure 14:
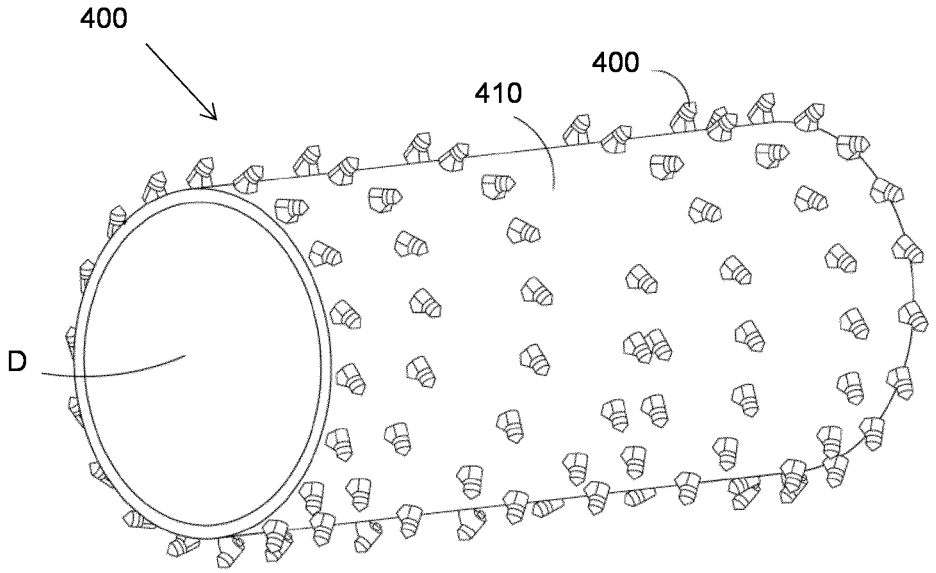
FIG. 14 shows a schematic perspective view of an example drum for a road milling machine.

An example pick assembly comprising a drum 400 is illustrated in FIG. 14, in which a plurality of pick tools 100 is attached to the curved surface 410 of the drum 400 via respective pick holders. The axis D of rotation of the drum 400 extends along the central axis of the drum 400, parallel to it's curved surface 410. The drum is capable of being mounted onto a drive vehicle that can drive the drum to rotate about the axis of rotation D.

In operation, the pick tools 100 can be driven as the drum 400 is driven to rotate. The picks 100 are arranged on the drum 400 such that when the drum 400 is driven to rotate in use, the cutting edges and strike surfaces of the pick tools 100 will be driven into a body (such as a road or rock formation) being degraded. The cutting edges of the strike members will cut into the body and material removed from the body will pass over the strike surfaces. Thus the super-hard strike structures of the pick tools will be driven to cut and dig into the body, breaking off material from the body.

Non-rotating picks may have the aspect that they may wear in a more predictable way than rotating picks, potentially because the latter my tend to become less rotatable with use due to the accumulation of debris between the pick shank and the holder.

Disclosed strike members and picks comprising them may be capable of good working life and high material removal efficiency. Disclosed arrangements may have the aspect of enhanced effectiveness of the pick in penetrating the body or formation being degraded and consequently the efficiency of the operation.

If the strike structure is too thin, it is likely to fracture prematurely in use. However, provided the strike structure is sufficiently thick, strike members with relatively simple configurations including substantially flat strike surfaces can be used. These are likely to be relatively easier and more efficient to manufacture, at least because they have relatively simple shapes and can be cut from a disc, for example.

Relatively thicker super-hard strike structures may be more readily manufactured by methods in which catalyst material for sintering the super-hard material is provided combined with grains of super-hard material in an aggregation to be sintered, as opposed to methods in which the catalyst material is provided only in the substrate. While wishing not to be bound by a particular theory, this may be because infiltration of molten catalyst material from a source outside the aggregation (e.g. the substrate) through the aggregation to be sintered may limit the thickness of the structure that can be sintered. Providing the catalyst material within the aggregation, as admixed grains or coatings on the super-hard grains for example, is likely to overcome this problem and permit sufficiently thick super-hard structures to be sintered.

Strike members in which the super-hard structure comprises alternating layers of different grades of the super-hard material and or in which the strike surface is coated with a protective coating may have the aspect of reduced risk of fracture, or substantially delayed fracture. Strike members in which a region of the substrate adjacent the super-hard structure has a relatively high elastic (e.g. Young's) modulus may also have this aspect. Strike members in which the super-hard material adjacent the strike surface contains voids may have the aspect that the geometry of the strike surface and the cutting edge may be capable of adapting to the conditions of use, such as the type of material being degraded, by a process of wear. While wishing not to be bound by a particular theory, slightly reduced wear resistance of the super-hard material adjacent the strike surface and cutting edge may reduce the likelihood of fracture of the super-hard structure when it strikes a body. This may be achieved, for example, by removing at least some of the filler material between grains of super-hard material in a polycrystalline super-hard structure and or by incorporating a layer of softer material bonded to the strike surface. In some examples, the fracture resistance may be enhanced by retaining filler material between the super-hard grains adjacent the strike surface. In general, measures to increase fracture resistance are likely to result in reduced wear resistance and a trade-off between these aspects may need to be achieved, which may depend on the super-hard material and the conditions of use.

Certain terms and concepts as used herein are briefly explained below.

Synthetic and natural diamond, polycrystalline diamond (PCD), cubic boron nitride (cBN) and polycrystalline cBN (PCBN) material are examples of superhard materials. As used herein, synthetic diamond, which is also called man-made diamond, is diamond material that has been manufactured. As used herein, polycrystalline diamond (PCD) material comprises an aggregation of a plurality of diamond grains, a substantial portion of which are directly inter-bonded with each other and in which the content of diamond is at least about 80 volume percent of the material. Interstices between the diamond grains may be at least partly filled with a filler material that may comprise catalyst material for synthetic diamond, or they may be substantially empty. As used herein, a catalyst material for synthetic diamond is capable of promoting the growth of synthetic diamond grains and or the direct inter-growth of synthetic or natural diamond grains at a temperature and pressure at which synthetic or natural diamond is thermodynamically stable. Examples of catalyst materials for diamond are Fe, Ni, Co and Mn, and certain alloys including these. Bodies comprising PCD material may comprise at least a region from which catalyst material has been removed from the interstices, leaving interstitial voids between the diamond grains.

As used herein, a PCD grade is a variant of PCD material characterised in terms of the volume content and or size of diamond grains, the volume content of interstitial regions between the diamond grains and composition of material that may be present within the interstitial regions. Different PCD grades may have different microstructure and different mechanical properties, such as elastic (or Young's) modulus E, modulus of elasticity, transverse rupture strength (TRS), toughness (such as so-called $K_1C$ toughness), hardness, density and coefficient of thermal expansion (CTE). Different PCD grades may also perform differently in use. For example, the wear rate and fracture resistance of different PCD grades may be different.

As used herein, PCBN material comprises grains of cubic boron nitride (cBN) dispersed within a matrix comprising metal or ceramic material.

Other examples of superhard materials include certain composite materials comprising diamond or cBN grains held together by a matrix comprising ceramic material, such as silicon carbide (SiC), or cemented carbide material, such as Co-bonded WC material (for example, as described in U.S. Pat. No. 5,453,105 or U.S. Pat. No. 6,919,040). For example, certain SiC-bonded diamond materials may comprise at least about 30 volume percent diamond grains dispersed in a SiC matrix (which may contain a minor amount of Si in a form other than SiC). Examples of SiC-bonded diamond materials are described in U.S. Pat. Nos. 7,008,672; 6,709,747; 6,179,886; 6,447,852; and International Application publication number WO2009/013713).

Where the weight or volume percent content of a constituent of a polycrystalline or composite material is measured, it is understood that the volume of the material within which the content is measured is to be sufficiently large that the measurement is substantially representative of the bulk characteristics of the material. For example, if PCD material comprises inter-grown diamond grains and cobalt filler material disposed in interstices between the diamond grains, the content of the filler material in terms of volume or weight percent of the PCD material should be measured over a volume of the PCD material that is at least several times the volume of the diamond grains so that the mean ratio of filler material to diamond material is a substantially true representation of that within a bulk sample of the PCD material (of the same grade).

The invention claimed is:

1. A pick tool comprising:

a strike member non-moveably attached to a pick body, the strike member comprising a strike structure in the form of a layer consisting of polycrystalline diamond (PCD) material joined to a cemented carbide substrate, and defining a planar strike surface, which defines a cutting edge;

the cutting edge including an apex in the plane of the strike surface, the apex being arcuate in the plane of the strike surface, and the cutting edge including substantially linear opposite edge segments diverging from the apex in the plane of the strike surface, in which the length of the cutting edge is 1.05 to 1.5 times the direct distance between opposite ends of the cutting edge;

the thickness of the layer being at least 2.5 millimeters over its entire volume, extending from the cutting edge to the opposite edge of the strike surface, the thickness measured from the strike surface to an opposite boundary of the strike structure.

2. A pick tool as claimed in claim 1, in which the cutting edge is radiused or chamfered.

3. A pick tool as claimed in claim 1, in which the cemented carbide substrate comprises a non-planar interface between the cemented carbide substrate and the PCD material, the non-planar interface being configured such that the PCD material is thicker at the apex than the at the opposite boundary of the strike surface.

4. A pick tool as claimed in claim 1, in which at least a region of the PCD material adjacent the cutting edge contains voids between diamond grains comprised in the PCD material.

5. A pick tool as claimed in any claim 1, in which at least a region of the PCD material adjacent the cutting edge contains filler material within interstices between diamond grains, the content of the filler material being greater than 5 weight percent of the PCD material in the region.

6. A pick tool as claimed in claim 1, in which the strike structure comprises a plurality of grades of PCD material arranged as strata in a layered configuration, adjacent strata being directly bonded to each other by inter-growth of diamond grains.

7. A pick tool as claimed in claim 1, in which the strike structure is joined to a substrate comprising an intermediate substrate volume and a distal substrate volume, the intermediate substrate volume being disposed between the strike structure and a distal substrate volume; the intermediate substrate volume comprising an intermediate material having a mean Young's modulus at least 60 percent that of the PCD material.

8. A pick tool as claimed in claim 1, for a road milling or mining apparatus.

9. An assembly comprising a pick tool as claimed in claim 1 and a carrier apparatus, the pick tool and the carrier apparatus being cooperatively configured such that the pick tool can be non-moveably attached to the carrier apparatus.

10. An assembly as claimed in claim 9, in which the carrier apparatus comprises a drum for a road milling or mining apparatus.

11. A method of making pick tools as claimed in claim 1, the method including:

providing an aggregation comprising a plurality of diamond grains and cobalt carbonate precursor material;

converting the cobalt carbonate to the corresponding cobalt oxide, reducing the cobalt oxide to form dispersed cobalt metal;

contacting the aggregation with a substrate comprising cemented tungsten carbide;

forming the aggregation into a pre-sinter disc structure; and subjecting the disc structure to a pressure and temperature at which the diamond grains are capable of inter-growth with each other in the presence of the cobalt metal to provide a construction, comprising a layer consisting of a layer of PCD material, the entire thickness of which is at least 2.5 mm and joined to the substrate, the PCD material defining a substantially planar surface of the construction;

cutting a plurality of segments from the construction, each segment having a substantially planar segment surface defined by the PCD material, the segment surface defining an edge including an apex in the plane of the segment surface;

processing each segment to provide a respective strike member; and attaching the strike member to the pick body such that the strike member is not capable of moving relative to the pick body.

12. A method as claimed in claim 11, including forming a radius or chamfer on the cutting edge.

* * * * *